US007845287B2

(12) United States Patent
Smith

(10) Patent No.: US 7,845,287 B2
(45) Date of Patent: Dec. 7, 2010

(54) STEERED AXLE RAILWAY TRUCK

(75) Inventor: Roy Edward Smith, Ontario (CA)

(73) Assignee: Restruck Technologies Inc., Kingston (CA)

( * ) Notice: Subject to any disclaimer, the term of this patent is extended or adjusted under 35 U.S.C. 154(b) by 367 days.

(21) Appl. No.: 12/019,274

(22) Filed: Jan. 24, 2008

(65) Prior Publication Data

US 2009/0025599 A1 Jan. 29, 2009

Related U.S. Application Data

(60) Provisional application No. 60/942,019, filed on Jun. 5, 2007.

(51) Int. Cl.
*B61F 5/00* (2006.01)

(52) U.S. Cl. ..... 105/168

(58) Field of Classification Search ..... 105/165, 105/166, 167, 168, 169, 4.4, 3
See application file for complete search history.

(56) References Cited

U.S. PATENT DOCUMENTS

| | | | | |
|---|---|---|---|---|
| 1,512 | A | 3/1840 | Stanley | |
| 1,855,997 | A | 4/1932 | Shannon | |
| 2,057,930 | A | 10/1936 | Strauss | |
| 2,058,955 | A | 10/1936 | Culemeyer | |
| 2,081,007 | A | 5/1937 | Geissen | |
| 2,098,723 | A | 11/1937 | Frei | |
| 5,131,332 | A | 7/1992 | Smith | |
| 5,282,425 | A * | 2/1994 | Timan | 105/168 |
| 5,746,134 | A | 5/1998 | Scheffel | |
| 7,047,889 | B2 | 5/2006 | Forbes | |
| 7,096,795 | B2 | 8/2006 | Wike | |
| 7,143,700 | B2 | 12/2006 | Forbes et al. | |

(Continued)

FOREIGN PATENT DOCUMENTS

CA 1073269 A1 3/1980

(Continued)

OTHER PUBLICATIONS

TP 14075E Title: Performance Testing of the Resco Steered Frame Freight Car Truck at the AAR Test Track, and Comparisons with Standard and Premium Three-Piece Trucks. By Resco Engineering; dated Mar. 2003.

(Continued)

*Primary Examiner*—Mark T Le
(74) *Attorney, Agent, or Firm*—Osler, Hoskin & Harcourt LLP

(57) ABSTRACT

A railway truck has a frame, and two wheel-sets operatively connected to the frame. Each wheel-set includes a corresponding axle, and two wheels disposed on the axle. A first steering lever is pivotally connected to the first end portion of the first axle about a first pivot axis and to the frame about a second pivot axis. A second steering lever is pivotally connected to the second end portion of the first axle about a third pivot axis and to the frame about a fourth pivot axis. A first line passing through the first and second pivot axes crosses a second line passing through the third and fourth pivot axes at less than a predetermined distance from a vertical centerline of the truck when the first and second axles are parallel. A railcar including the truck is also provided.

23 Claims, 10 Drawing Sheets

U.S. PATENT DOCUMENTS

| | | | |
|---|---|---|---|
| 2004/0112246 | A1 | 6/2004 | Gain et al. |
| 2004/0221673 | A1 | 11/2004 | Mojzis |
| 2005/0183625 | A1 | 8/2005 | Goding et al. |
| 2006/0249046 | A1 | 11/2006 | Wike |

FOREIGN PATENT DOCUMENTS

| | | | |
|---|---|---|---|
| CA | 1188157 | A1 | 6/1985 |
| CA | 2000748 | A | 4/1991 |
| EP | 0258502 | A1 | 3/1988 |
| EP | 0365489 | A2 | 4/1990 |
| EP | 0368403 | A1 | 5/1990 |
| WO | WO9418048 | A1 | 8/1994 |

OTHER PUBLICATIONS

TP 14632E Title: Service Testing of the Resco Steered Frame Freight Car Truck on the Norfolk Southern Railway, and Comparisons with Standard and Premium Three-Piece Trucks. By Resco Engineering; dated Oct. 2006.

Title: A New Freight Car Truck for Heavy Haul. By Roy E. Smith; Montreal Jun. 9, 1996 (Best available copy).

International Search Report from PCT/CA2008/000253.

* cited by examiner

STEERED AXLE RAILWAY TRUCK

CROSS-REFERENCE

The present application claims priority to U.S. Provisional Patent Application No. 60/942,019 filed on Jun. 5, 2007, the entirety of which is incorporated herein by reference.

FIELD OF THE INVENTION

The present invention relates to railway trucks used in the rail industry. More specifically, the present invention relates to steered axle railway trucks.

BACKGROUND

A typical railcar includes a carbody that rides on one or more railway trucks or bogies. The carbody may be a freight container, a passenger compartment, a locomotive body, or any other type of vehicle used for transport by rail. The trucks support the carbody vertically and laterally while allowing sufficient rotational movement between the truck and carbody to allow negotiation of curved track.

The trucks are generally proximate to each end of the carbody and support the carbody for transport along the rail. Each truck generally includes a frame that connects a pair (or more) of wheel-sets. The frame generally includes a pair of side-frames that extend along the length of each side of the truck. A transverse frame, or a bolster, may connect the side-frames, to hold the side-frames generally parallel to one another.

Each wheel-set generally includes an axle, a pair of conical wheels, and a pair of bearing assemblies. The conical wheels are fixedly connected proximate each end of the axle. The bearing assemblies connect the wheel-sets to the side-frames to allow the conical wheels and axles to rotate together as the truck moves along the rail.

In conventional truck designs, the wheel-sets are fixed to the frame so that the fixed wheel-sets within each truck are generally parallel to one another and perpendicular to the side-frames at all times. Although this arrangement generally allows the wheels to be aligned to straight track, and roughly aligns the wheels to curved track, there is always an error in the alignment of the wheels to the curves. Even slight misalignment between the wheels and the rails causes a great deal of noise and wear, as well as creating substantial resistance to the rolling of the wheels. Another detriment of wheel/rail misalignment is that it creates the tendency for wheels to climb up the rails.

Many attempts have been made to reduce or prevent any slight misalignment between the wheels and the rail by steering the axles. One of the earliest of such attempts is described in U.S. Pat. No. 1,512 issued to I. N. Stanley in 1840—only a few years after the first Stephenson locomotive was introduced into North America. In many of the attempts, one or both wheel-sets are steerable so that the steerable wheel-set (s) can move laterally and/or longitudinally with respect to the frame and/or the other wheel-sets to adjust the alignment of the wheel-sets with respect to the rails.

Although various prior art designs incorporate linkages or levers of varying geometries and orientations to displace the wheel-sets with respect to the frame, most of these require mechanisms at both wheel sets and most require a significant force to be overcome to create the steering.

Therefore, there is a need for steered axle railway truck that reduces the misalignment between the wheel-sets and the track by using a mechanism at a single wheel set.

Therefore, there is also a need for steered axle railway truck that reduces the misalignment between the wheel-sets and the track by using a mechanism that requires less force than the prior art to create the steering.

SUMMARY

It is an object of the present to ameliorate at least some of the inconveniences present in the prior art.

It is also an object of the present to provide a railway truck having a pair of steering levers for steering the railway truck.

It is another object of the present to provide a railcar including a carbody and at least two railway trucks having a pair of steering levers for steering at least one of the railway trucks.

It is also an object of the present to provide a railway truck having a pair of steering levers for steering an axle of the railway truck relative to a frame of the railway truck to bring the axle into alignment with a center of curvature of the track and that the steering of the axle causes a displacement of the frame such that another axle, which has a fixed position relative to the frame, is also brought into alignment with the centre of curvature of the track.

In one aspect, a railway truck has a frame, a first wheel-set operatively connected to the frame and a second wheel-set operatively connected to the frame. The first wheel-set includes a first axle having a first end portion and a second end portion opposite the first end portion, a first wheel disposed on the first end portion of the first axle, and a second wheel disposed on the second end portion of the first axle. The second wheel-set includes a second axle having a first end portion and a second end portion opposite the first end portion, a third wheel disposed on the first end portion of the second axle, and a fourth wheel disposed on the second end portion of the second axle. A first steering lever is pivotally connected to the first end portion of the first axle about a first generally vertical pivot axis. The first steering lever is pivotally connected to the frame about a second generally vertical pivot axis. The first pivot axis is laterally offset from the second pivot axis. A second steering lever is pivotally connected to the second end portion of the first axle about a third generally vertical pivot axis. The second steering lever is pivotally connected to the frame about a fourth generally vertical pivot axis. The third pivot axis is laterally offset from the fourth pivot axis. A first steering rod has a first end pivotally connected to the first steering lever at a point laterally offset from the first and second pivot axes and a second end adapted to be operatively pivotally connected to a carbody. A first generally horizontal line passing through the first and second pivot axes crosses a second generally horizontal line passing through the third and fourth pivot axes at less than a predetermined distance from a vertical centerline of the truck when the first and second axles are parallel. The vertical centerline passes through a geometric center of the first and second wheel-sets. The geometric center is a point that is equidistant from a center of each of the first, second, third, and fourth wheels when the first and second axles are parallel.

In a further aspect, the predetermined distance is less than or equal to one quarter of a wheelbase of the truck.

In an additional aspect, the first line and the second line cross at the vertical centerline of the truck.

In a further aspect, rotation of the first steering lever about the second pivot axis in a first direction and of the second steering lever about the fourth pivot axis in the first direction causes displacement of the first and third pivot axes and results in a rotation of the first wheel-set about a vertical axis.

In an additional aspect, the railway truck also has a first bearing adapter journaled on the first end portion of the first axle, and a second bearing adapter journaled on the second end portion of the first axle. The first steering lever is pivotally connected to the first bearing adapter about the first pivot axis, and the second steering lever is pivotally connected to the second bearing adapter about the third pivot axis.

In a further aspect, the first steering lever includes first inner arcuate surfaces journaling corresponding outer surfaces of the first bearing adapter, a center of curvature of the first inner arcuate surfaces corresponding to the first pivot axis, and first outer arcuate surfaces journaled in corresponding first inner arcuate surfaces of the frame, a center of curvature of the first outer arcuate surfaces corresponding to the second pivot axis. The second steering lever includes second inner arcuate surfaces journaling corresponding outer surfaces of the second bearing adapter, a center of curvature of the second inner arcuate surfaces corresponding to the third pivot axis, and second outer arcuate surfaces journaled in corresponding second inner arcuate surfaces of the frame, a center of curvature of the second outer arcuate surfaces corresponding to the fourth pivot axis.

In an additional aspect, the first steering lever is generally C-shaped and has a first vertical member and a first pair of horizontal members extending from the first vertical member. The first vertical member is pivotally connected to the frame about the second pivot axis, and the first bearing adapter is pivotally connected between the first pair of horizontal member about the first pivot axis. The second steering lever is generally C-shaped and has a second vertical member and a second pair of horizontal members extending from the second vertical member. The second vertical member is pivotally connected to the frame about the fourth pivot axis, and the second bearing adapter is pivotally connected between the second pair of horizontal member about the third pivot axis.

In a further aspect, the railway truck also has a second steering rod having a first end pivotally connected to the second steering lever at a point laterally offset from the third and fourth pivot axes and a second end adapted to be operatively pivotally connected to the carbody.

In an additional aspect, the frame includes a pair of side-frames, a bolster extending between the pair of side-frames, and a suspension operatively connecting the bolster to the side-frames.

In another aspect, a railway truck has a frame, a first wheel-set operatively connected to the frame and a second wheel-set operatively connected to the frame. The first wheel-set includes a first axle having a first end portion and a second end portion opposite the first end portion, a first wheel disposed on the first end portion of the first axle, and a second wheel disposed on the second end portion of the first axle. The second wheel-set includes a second axle having a first end portion and a second end portion opposite the first end portion, a third wheel disposed on the first end portion of the second axle, and a fourth wheel disposed on the second end portion of the second axle. A first bearing adapter is journaled on the first end portion of the first axle. A second bearing adapter is journaled on the second end portion of the first axle. A first steering lever is pivotally connected to the first bearing adapter about a first generally vertical pivot axis. The first steering lever is pivotally connected to the frame about a second generally vertical pivot axis. The first pivot axis is laterally offset from the second pivot axis. The first steering lever includes first inner arcuate surfaces journaling corresponding outer surfaces of the first bearing adapter, a center of curvature of the first inner arcuate surfaces corresponding to the first pivot axis, and first outer arcuate surfaces journaled in corresponding first inner arcuate surfaces of the frame, a center of curvature of the first outer arcuate surfaces corresponding to the second pivot axis. A second steering lever is pivotally connected to the second bearing adapter about a third generally vertical pivot axis. The second steering lever is pivotally connected to the frame about a fourth generally vertical pivot axis. The third pivot axis is laterally offset from the fourth pivot axis. The second steering lever includes second inner arcuate surfaces journaling corresponding outer surfaces of the second bearing adapter, a center of curvature of the second inner arcuate surfaces corresponding to the third pivot axis, and second outer arcuate surfaces journaled in corresponding second inner arcuate surfaces of the frame, a center of curvature of the second outer arcuate surfaces corresponding to the fourth pivot axis. A first generally horizontal line passing through the first and second pivot axes crosses a second generally horizontal line passing through the third and fourth pivot axes at less than a predetermined distance from a vertical centerline of the truck when the first and second axles are parallel. The vertical centerline passes through a geometric center of the first and second wheel-sets. The geometric center is a point that is equidistant from a center of each of the first, second, third, and fourth wheels when the first and second axles are parallel.

In a further aspect, the predetermined distance is less than or equal to one quarter of a wheelbase of the truck.

In an additional aspect, the first line and the second line cross at the vertical centerline of the truck.

In a further aspect, rotation of the first steering lever about the second pivot axis in a first direction and of the second steering lever about the fourth pivot axis in the first direction causes displacement of the first and third pivot axes and results in a rotation of the first wheel-set about a vertical axis.

In another aspect, a railcar has at least two railway trucks. Each of the at least two railway trucks includes a frame, a first wheel-set operatively connected to the frame, and a second wheel-set operatively connected to the frame. The first wheel-set includes a first axle having a first end portion and a second end portion opposite the first end portion, a first wheel disposed on the first end portion of the first axle, and a second wheel disposed on the second end portion of the first axle. The second wheel-set includes a second axle having a first end portion and a second end portion opposite the first end portion, a third wheel disposed on the first end portion of the second axle, and a fourth wheel disposed on the second end portion of the second axle. At least one of the at least two railway trucks also includes a first steering lever and a second steering lever. The first steering lever is pivotally connected to the first end portion of the first axle about a first generally vertical pivot axis. The first steering lever is pivotally connected to the frame about a second generally vertical pivot axis. The first pivot axis is laterally offset from the second pivot axis. The second steering lever is pivotally connected to the second end portion of the first axle about a third generally vertical pivot axis. The second steering lever is pivotally connected to the frame about a fourth generally vertical pivot axis. The third pivot axis is laterally offset from the fourth pivot axis. A first generally horizontal line passing through the first and second pivot axes crosses a second generally horizontal line passing through the third and fourth pivot axes at less than a predetermined distance from a vertical centerline of the at least one of the at least two railway trucks when the first and second axles are parallel. The vertical centerline passes through a geometric center of the first and second wheel-sets. The geometric center is a point that is equidistant from a center of each of the first, second, third, and fourth wheels when the first and second axles are parallel. A carbody is pivotally supported by the frame of the at least one of the at least two railway trucks and is supported by the frame of the other of the at least two railway trucks. A first steering rod has a first end pivotally connected to the first steering lever at a point laterally offset from the first and second pivot axes and a second end operatively pivotally connected to the carbody.

In an additional aspect, a second steering rod has a first end pivotally connected to the second steering lever at a point laterally offset from the third and fourth pivot axes and a second end operatively pivotally connected to the carbody.

In a further aspect, the predetermined distance is less than or equal to one quarter of a wheelbase of the at least one of the at least two railway trucks.

In an additional aspect, the first line and the second line cross at the vertical centerline of the at least one of the at least two railway trucks.

In a further aspect, rotation of the carbody relative to the frame of the at least one of the at least two railway trucks causes rotation of the first steering lever about the second pivot axis in a first direction and rotation of the second steering lever about the fourth pivot axis in the first direction. The rotation of the first and second steering levers in the first direction causes displacement of the first and third pivot axes and results in a rotation of the first wheel-set about a vertical axis.

In an additional aspect, the at least one of the at least two railway trucks further includes a first bearing adapter journaled on the first end portion of the first axle, and a second bearing adapter journaled on the second end portion of the first axle. The first steering lever is pivotally connected to the first bearing adapter about the first pivot axis, and the second steering lever is pivotally connected to the second bearing adapter about the third pivot axis.

In a further aspect, the first steering lever includes first inner arcuate surfaces journaling corresponding outer surfaces of the first bearing adapter, a center of curvature of the first inner arcuate surfaces corresponding to the first pivot axis, and first outer arcuate surfaces journaled in corresponding first inner arcuate surfaces of the frame, a center of curvature of the first outer arcuate surfaces corresponding to the second pivot axis. The second steering lever includes second inner arcuate surfaces journaling corresponding outer surfaces of the second bearing adapter, a center of curvature of the second inner arcuate surfaces corresponding to the third pivot axis, and second outer arcuate surfaces journaled in corresponding second inner arcuate surfaces of the frame, a center of curvature of the second outer arcuate surfaces corresponding to the fourth pivot axis.

In an additional aspect, the first steering lever is generally C-shaped and has a first vertical member and a first pair of horizontal members extending from the first vertical member. The first vertical member is pivotally connected to the frame about the second pivot axis, and the first bearing adapter is pivotally connected between the first pair of horizontal member about the first pivot axis. The second steering lever is generally C-shaped and has a second vertical member and a second pair of horizontal members extending from the second vertical member. The second vertical member is pivotally connected to the frame about the fourth pivot axis, and the second bearing adapter is pivotally connected between the second pair of horizontal member about the third pivot axis.

In a further aspect, the frame of each of the at least two railway trucks includes a pair of side-frames, a bolster extending between the pair of side-frames and pivotally supporting the carbody, and a suspension operatively connecting the bolster to the side-frames.

In an additional aspect, the at least one of the at least two railway trucks is disposed near a first end of the carbody and the other one of the at least two railway trucks is disposed near a second end of the carbody opposite the first end. The other one of the at least two railway trucks also includes a first steering lever and a second steering lever. The first steering lever is pivotally connected to the first end portion of the first axle about a first generally vertical pivot axis. The first steering lever is pivotally connected to the frame about a second generally vertical pivot axis. The first pivot axis is laterally offset from the second pivot axis. The second steering lever is pivotally connected to the second end portion of the first axle about a third generally vertical pivot axis. The second steering lever is pivotally connected to the frame about a fourth generally vertical pivot axis. The third pivot axis is laterally offset from the fourth pivot axis. A first generally horizontal line passing through the first and second pivot axes crosses a second generally horizontal line passing through the third and fourth pivot axes at less than a predetermined distance from a vertical centerline of the other of the at least two railway trucks when the first and second axles are parallel. The vertical centerline passes through a geometric center of the first and second wheel-sets. The geometric center is a point that is equidistant from a center of each of the first, second, third, and fourth wheels when the first and second axles are parallel.

For purposes of this application, the terms "journaled" and "journaling" refer to an arrangement of parts where one part can rotate inside the other or slide in an arc along the other. These terms are not intended to be limited to having a journal (e.g. a journal bearing), but rather are intended to include any rotating arrangement (e.g. a ball or roller bearing between the two parts).

Embodiments described herein each have at least one of the above-mentioned objects and/or aspects, but do not necessarily have all of them. It should be understood that some aspects that have resulted from attempting to attain the above-mentioned objects may not satisfy these objects and/or may satisfy other objects not specifically recited herein.

Additional and/or alternative features, aspects, and advantages of the embodiments will become apparent from the following description, the accompanying drawings, and the appended claims.

BRIEF DESCRIPTION OF THE DRAWINGS

For a better understanding, reference is made to the following description which is to be used in conjunction with the accompanying drawings, where.

DETAILED DESCRIPTION OF THE PREFERRED EMBODIMENTS

Reference will now be made in detail to present embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 5:
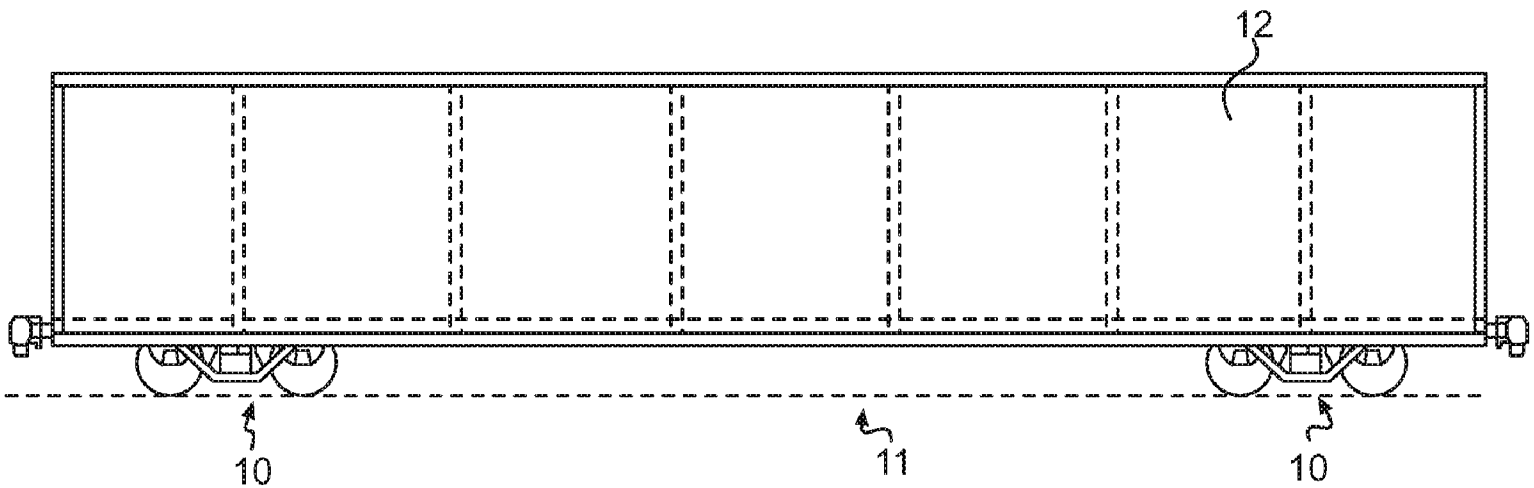
FIG. 5 is a schematic side elevation view of a railcar including the truck shown in FIG. 1.

As shown in FIG. 5, a railcar 11 has a carbody 12 that rests on a pair of steered axle railway trucks 10. The carbody 12 may be a freight container, a passenger compartment, or any other carrier transported by rail. The steered axle railway trucks 10 support the carbody 12 vertically and pivotally for allowing slight rotational movement between the trucks 10 and carbody 12. This arrangement allows the steered axle railway trucks 10 to rotate slightly under the carbody 12 to maintain alignment with the rail as the railcar 11 travels along the rail.

Figure 1:
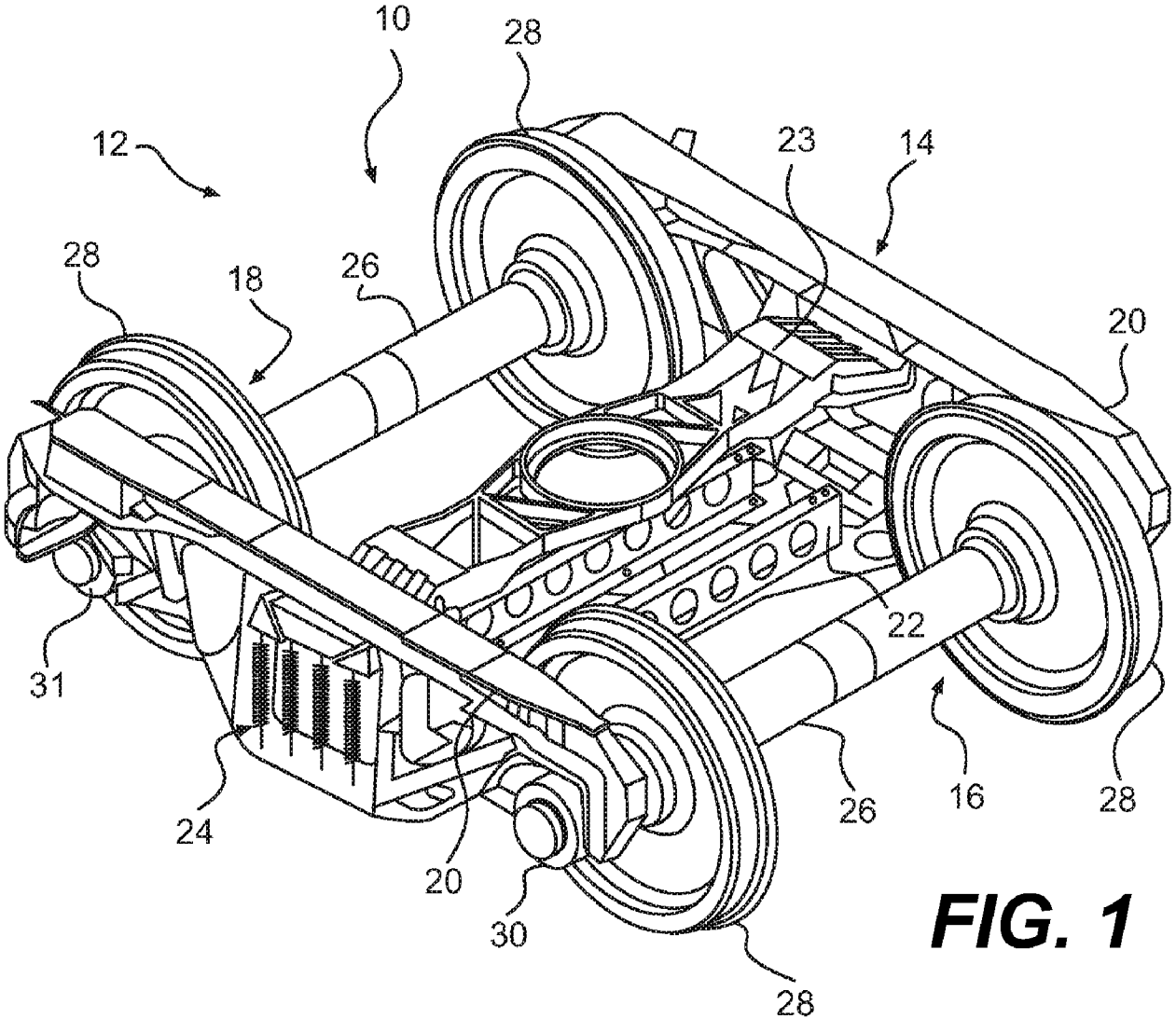
FIG. 1 is a perspective view of a steered axle railway truck according to one embodiment.

FIG. 1 illustrates a perspective view of a steered axle railway truck 10 according to one embodiment. The steered axle railway truck 10 includes a frame 14, a fixed wheel-set 16, and a steerable wheel-set 18. The frame 14 generally includes a pair of side-frames 20 that extend along the length of each side of the steered axle railway truck 10. A transverse frame 22 connects to the side-frames 20 to hold the side-frames 20 generally parallel to one another. A bolster 23 extends from one side-frame 20 to the other and pivotally supports the carbody 12. Suspension components 24 located on the side-frames 20 are connected to the bolster 23 to reduce the transmission of vibrations from the truck 10 to the carbody 12.

Each wheel-set 16, 18 generally includes an axle 26, a pair of conical wheels 28, and bearing assemblies 30 (for the fixed-wheel set 16) or 31 (for the steerable wheel set 18). The bearing assemblies 30, 31 preferably each include a tapered roller bearing. It is contemplated that other types of bearings could be used. Each bearing assembly 31 also includes a bearing adapter 33 (FIG. 2A) disposed around the outer race of the tapered roller bearing, as described in greater detail below. The conical wheels 28 are fixedly connected to the axles 26 proximate each end of the axles 26. In this manner, the conical wheels 28 rotate at the same speed as the axles 26. The bearing assemblies 30, 31 are outboard of each conical wheel 28 to operably connect each wheel-set 16, 18 to the side-frames 20 so that the axles 26 and wheels 28 rotate freely as the truck 10 travels along the rails. It should be understood by one of ordinary skill in the art that alternate designs are contemplated and include other physical arrangements between the axle 26, conical wheels 28, and bearing assemblies 30. For example, in some embodiments, the bearing assemblies 30 may be located inboard of the conical wheels 28. Alternatively, the conical wheels 28 may be operably connected to the axle 26, with or without bearings, to allow the wheels 28 to rotate separately from the axles 26.

Figure 2:
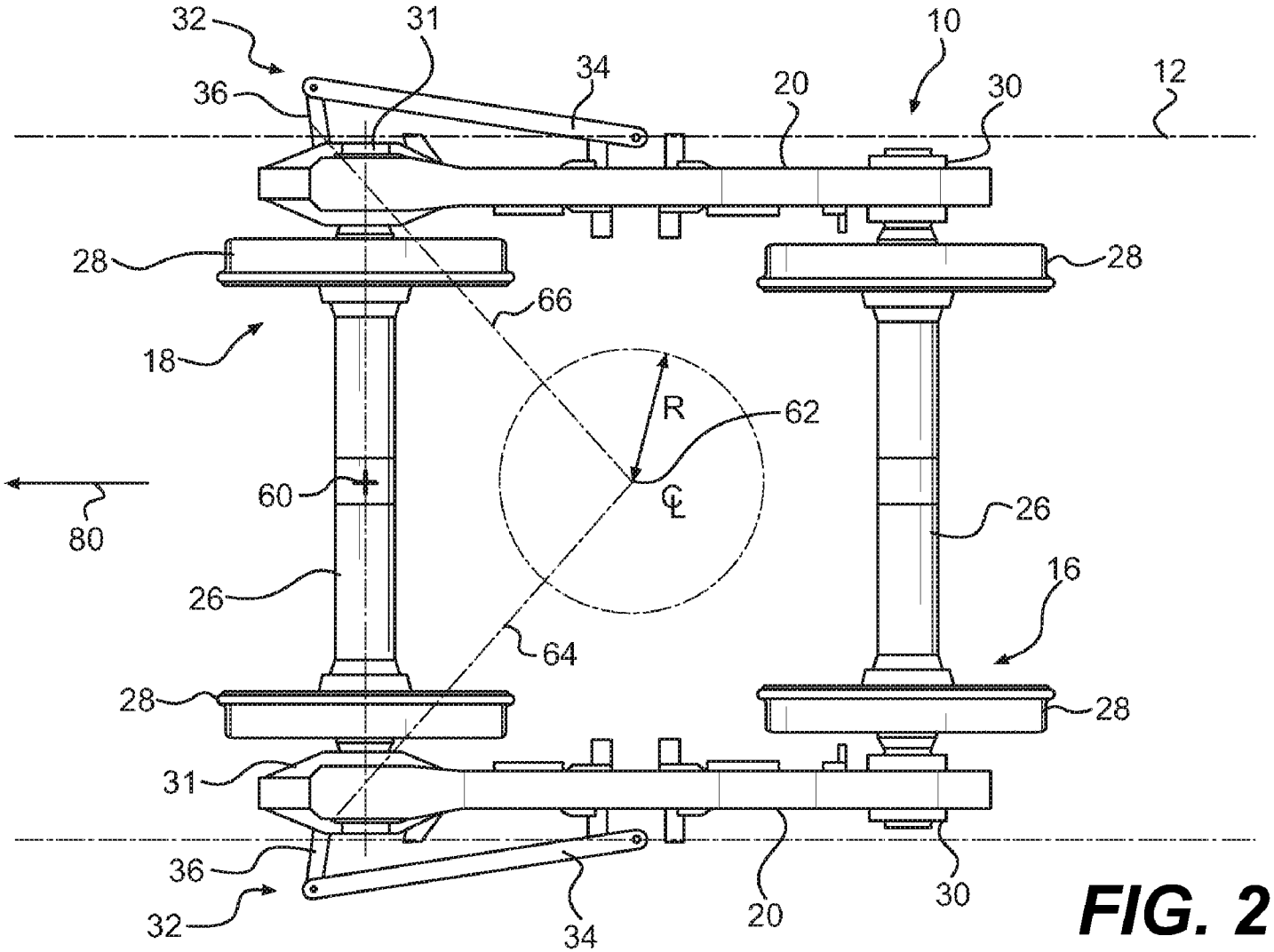
FIG. 2 is a simplified top plan view of a steered axle railway truck according to one embodiment traveling straight.

FIG. 2 illustrates a simplified top plan view of the steered axle railway truck 10 according to one embodiment traveling straight. As shown, the bearing assemblies 30 operatively connect the fixed wheel-set 16 to the side-frames 20 so that the fixed wheel-set 16 is generally perpendicular to the side-frames 20 at all times. In contrast, the bearing assemblies 31 operably connects the steerable wheel-set 18 to the side-frames 20 through steering assemblies 32, disposed at each end portion of the axle 26, so that the steerable wheel-set 18 can rotate and/or move laterally with respect to the side-frames 20.

Each steering assembly 32 generally includes a steering rod 34 and a steering lever 36. The steering rod 34 is an elongate shaft or rod. The steering rod 34 pivotally connects to the steering lever 36 at one end and to the carbody 12 at the other end. The connection points may be universal joints, bearings, pins, or other suitable means known in the art for pivotal connections. The connection points may include resilient mounts or surfaces to dampen or buffer the responsiveness of the steering rod 34 and steering lever 36. It is contemplated that only one of the steering assemblies 32 could have a steering rod 34 such that only one steering lever 36 is connected to the carbody 12.

Figure 2A:
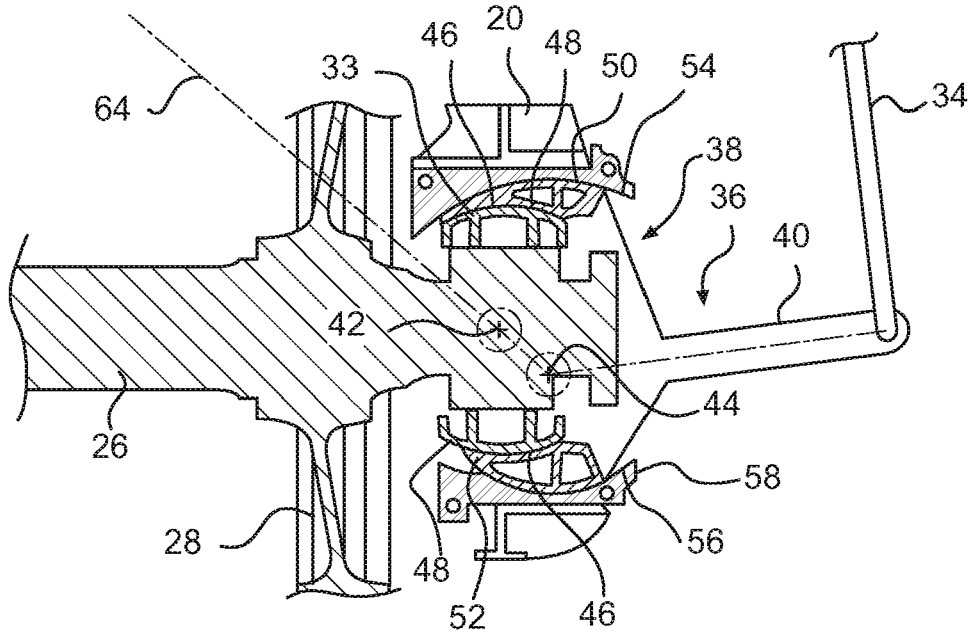
FIG. 2A is a cross-sectional view of a left portion of the steerable wheel-set and frame shown in FIG. 2.

As shown in FIG. 2A, the steering lever 36 includes a main portion 38 and an elongate lever 40. The main portion 38 pivotally connects to the bearing adapter 33 about a first pivot axis 42 and to the side-frame 20 about a second pivot axis 44. The first and second pivot axis 42 and 44 are offset from each other. The elongate lever 40 of the steering lever 36 pivotally connects to the steering rod 34 as previously described.

The main portion 38 of the steering lever 36 has first inner arcuate surfaces 46 that journal corresponding outer surfaces 48 of the bearing adapter 33. The center of curvature of the surfaces 46 and 48 correspond to the first pivot axis 42. The main portion 38 of the steering lever 36 also has outer arcuate surfaces 50 and 52 that are journaled in corresponding inner arcuate surfaces 54 and 56 of a side-frame adapter 58 that forms part of the side-frame 20. Arcuate surfaces 50, 52, 54, and 56 have a common center of curvature that corresponds to the second pivot axis 44. As can be seen in FIG. 2A, arcuate surfaces 50 and 54 have a larger radius of curvature than arcuate surfaces 52 and 56, however it is contemplated that they could have the same radius of curvature. It is also contemplated that arcuate surfaces 50 and 54 could have a smaller radius of curvature than arcuate surfaces 52 and 56, but still have a common center of curvature. The radius of curvature of the surfaces 46 and 48 is less than the radii of curvature of the surfaces 50, 52, 54, and 56. The steering lever 36 disposed at the opposite end portion of the axle 26 from the one illustrated in FIG. 2A is a mirror image of the one described above and therefore will not be described herein. As will be described in greater detail below with respect to FIGS. 3, 3A, 4, and 4A, when the steering rod 34 pushes or pulls on the elongate lever 40, the steering lever 36 pivots about the second pivot axis 44 which causes the first pivot 42, and therefore the end of steerable wheel-set 18, to be displaced. Since one end of the first wheel-set 26 is displaced forwardly and inwardly while the other end is displaced rearwardly and outwardly (assuming the steerable wheel-set 18 is disposed forwardly of the fixed wheel-set 16), the steerable wheel-set 18 is effectively rotated about a vertical axis 60 (FIG. 2) located at or near the center of the axle 26 so as to bring the axle 26 of the steerable wheel-set 18 into alignment with a center of curvature of the track. This rotation of the steerable wheel-set 18 also causes a displacement of the frame 14 such that the axle 26 of the fixed wheel-set 16 is brought into alignment with a center of curvature of the track.

When the steered axle railway truck 10 is traveling straight, as shown in FIGS. 2 and 2A, the steerable wheel-set 18 is generally perpendicular to the side-frames 20, and thus generally parallel to the fixed wheel-set 16. When traveling straight, the fixed 16 and steerable wheel-sets 18 define a geometric center 62 of the wheel-sets 16, 18, which is a point equidistant from all four wheels 28 when traveling straight. The geometry of the steering assemblies 32 is selected such that a first line 64 passing through the first and second pivot axes 42 and 44 of one steering assembly 32 crosses a second line 66 passing through the first and second pivot axes 42 and 44 of the other steering assembly 32 at less than a predetermined distance R from a vertical centerline passing through the geometric center 62 of the truck 10 when the axles 26 are parallel to each other. In a preferred embodiment the distance R is less than or equal to one quarter of the wheelbase of the truck (i.e. the distance from the center of one axle 26 to the other). Preferably, the lines 64 and 66 cross at the vertical centerline passing through the geometric center 62 of the truck 10.

The operation of the steered axle railway truck will now be described. By convention, FIGS. 3, 3A, 4, and 4A illustrate the relative movement between the steerable wheel-set 18 and the fixed wheel-set 16 (and side-frames 20) by only moving the steerable wheel-set 18 and steering assembly 32 and maintaining the position of the fixed wheel-set 16 and side-frames 20 constant. In addition, by convention, the steered axle railway trucks 10 illustrated in the figures are assumed to be positioned under either end of the carbody 12 so that the steerable wheel-set 18 is outboard and the fixed wheel-set 16 is inboard, relative to the ends of the carbody 12. One of ordinary skill in the art can readily appreciate the simple changes necessary in the various pivot points if the steered axle railway truck 10 were positioned under either end of the carbody 12 so that the steerable wheel-set 18 were inboard and the fixed wheel-set 16 were outboard, relative to the ends of the carbody 12. For clarity, operation of the steerable wheel-set 18 will be described with respect to one side of the steering assembly 32 only. One of ordinary skill in the art should appreciate that the steering assembly 32 on the other side of the steerable wheel-set 18 would generally operate in the opposite direction described.

Figure 6:
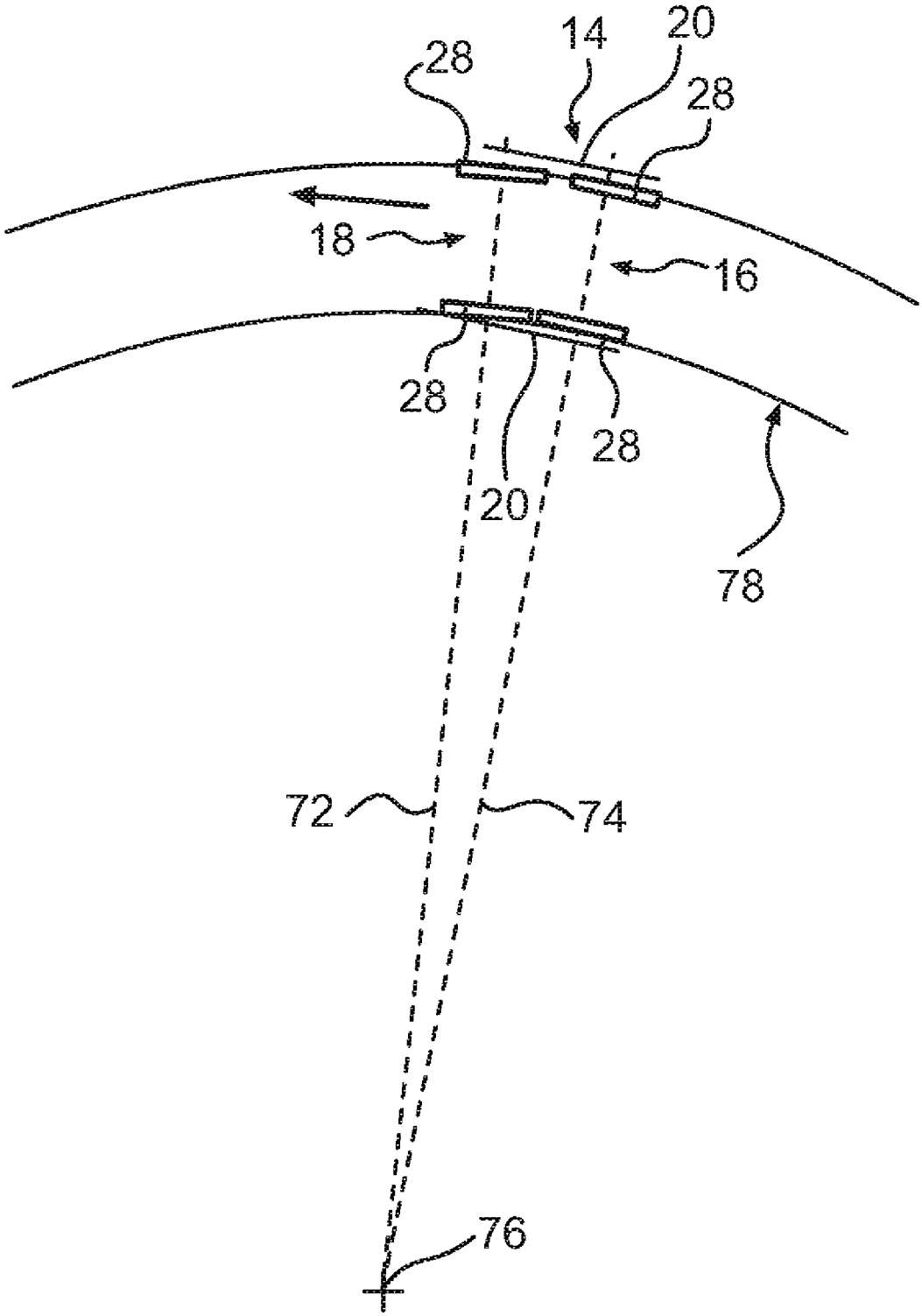
FIG. 6 is a schematic top view of the steered axle railway truck of FIG. 1 in a left turn.

As previously discussed, the fixed wheel-set 16 remains generally perpendicular to the side-frames 20 at all times and through all turns. In general, when the steered axle railway truck 10 enters a curve, rotation of the carbody 12 with respect to the truck 10 causes the steering rods 34 to push or pull on the steering lever 36, as shown by the arrows 68 in FIGS. 3 and 4. The rotation of the carbody 12 relative to the truck 10 is proportional to the degree of curvature of the rail (i.e., the sharper the curve, the greater the swivel angle), so the amount of steering action will be proportional to the degree of curvature in the rail. As the steering rod 34 pushes or pulls on the steering lever 36, the steering lever 36 rotates about the second pivot axis 44 to displace the bearing assembly 31, and thus the steerable wheel-set 18, with respect to the fixed wheel-set 16 and side-frames 20, as shown by the arrows 70 in FIGS. 3 and 4. The displacement of the steerable wheel-set 18 relative to the fixed wheel-set 16 and side-frames 20 places both of the wheel-sets 16 and 18 in radial alignment with the curve in the rail. In other words, and as shown in FIG. 6, in a preferred embodiment, a first axle axis 72 and a second axle axis 74, defined by an axle 26 of the steerable wheel-set 18 and an axle 26 of the fixed wheel-set 16 respectively, pass through a center of curvature 76 of the curved portion of the track 78.

Figure 3A:
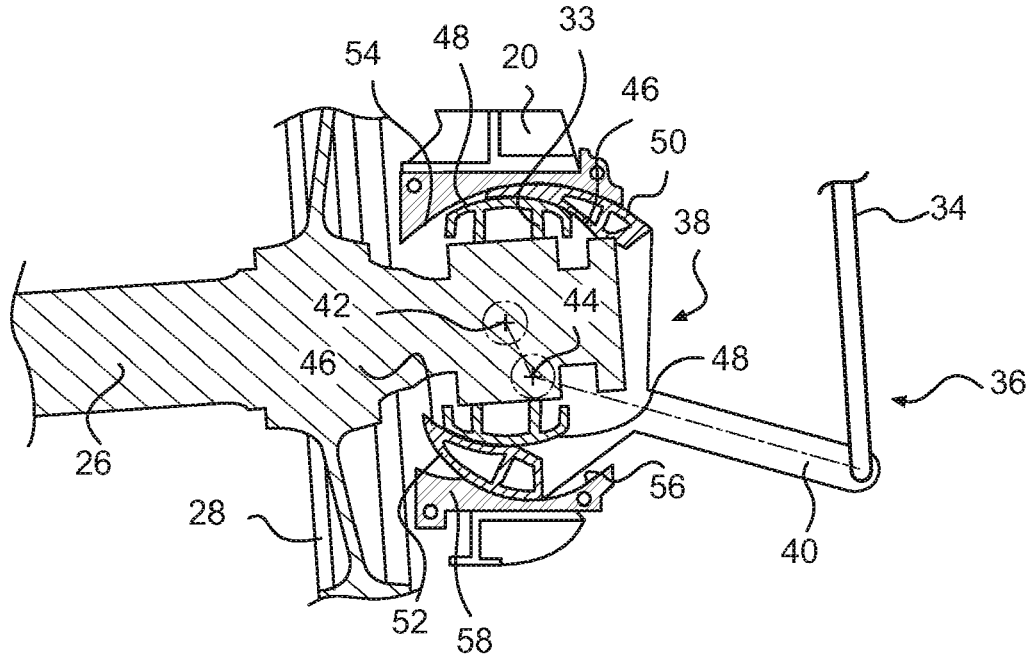
FIG. 3A is a cross-sectional view of a left portion of the steerable wheel-set and frame shown in FIG. 3.
Figure 3:
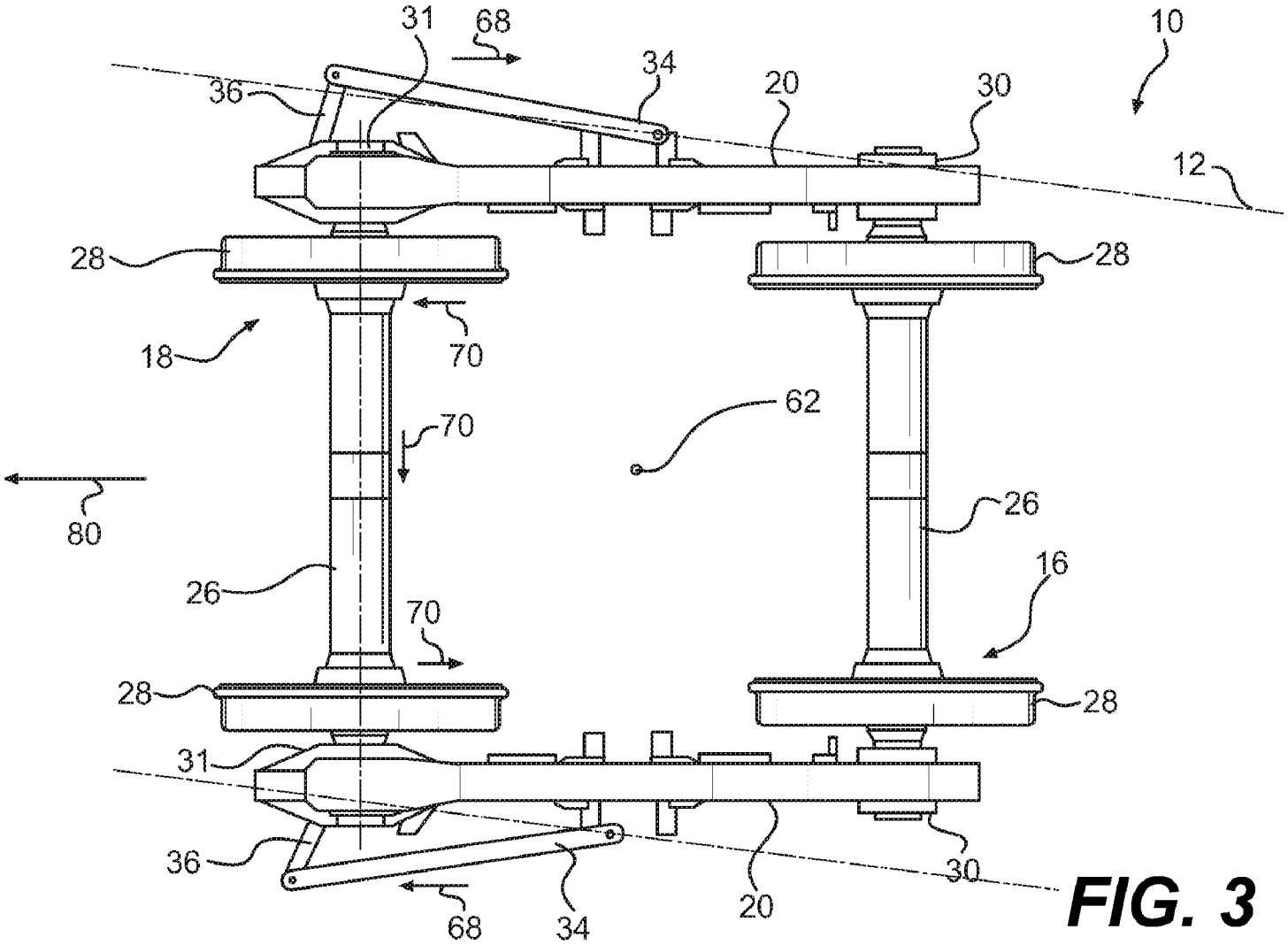
FIG. 3 is a simplified top plan view of a steered axle railway truck according to one embodiment in a left turn.

Referring to FIGS. 3 and 3A, as the steered axle railway truck 10 moves in the direction illustrated by arrow 80 and enters a curve to the left, the inertia of the carbody 12 causes the carbody 12 to rotate slightly clockwise relative to the steered axle railway truck 10. As a result, the carbody 12 pushes the steering rod 34 on the left side of the truck 10 (the bottom on FIG. 3) forwardly and pulls the steering rod 34 on the right side of the truck 10 (the top on FIG. 3) rearwardly, as shown by arrows 68. Movement of the steering rods 34 pushes or pulls, as the case may be, on the elongate levers 40 of each of the steering levers 36 to cause the main portions 38 of each steering lever 36 to slide in their corresponding arcuate surfaces 54 and 56 and rotates the steering levers 36 clockwise about their corresponding second pivot axis 44. As the left steering lever 36 rotates clockwise about its second pivot axis 44, the pivotal connection between the steering lever 36 and the bearing assembly 31 at the first pivot axis 42 displaces the bearing assembly 31, and thus the left end portion of the steerable wheel set 18, laterally outwardly and rearwardly with respect to the fixed wheel-set 16 and side-frames 20, as shown by arrows 70. As the right steering lever 36 rotates clockwise about its second pivot axis 44, the pivotal connection between the steering lever 36 and the bearing assembly 31 at the first pivot axis 42 displaces the bearing assembly 31, and thus the right end portion of the steerable wheel set 18, laterally inwardly and forwardly with respect to the fixed wheel-set 16 and side-frames 20, as shown by arrows 70. As a result of this displacement, the steerable wheel-set 18 is no longer perpendicular to the side-frames 20 or parallel to the fixed wheel-set 16, and the steerable wheel-set 18 and fixed wheel-set 16 are both radially aligned with the curve of the rail.

Figure 4:
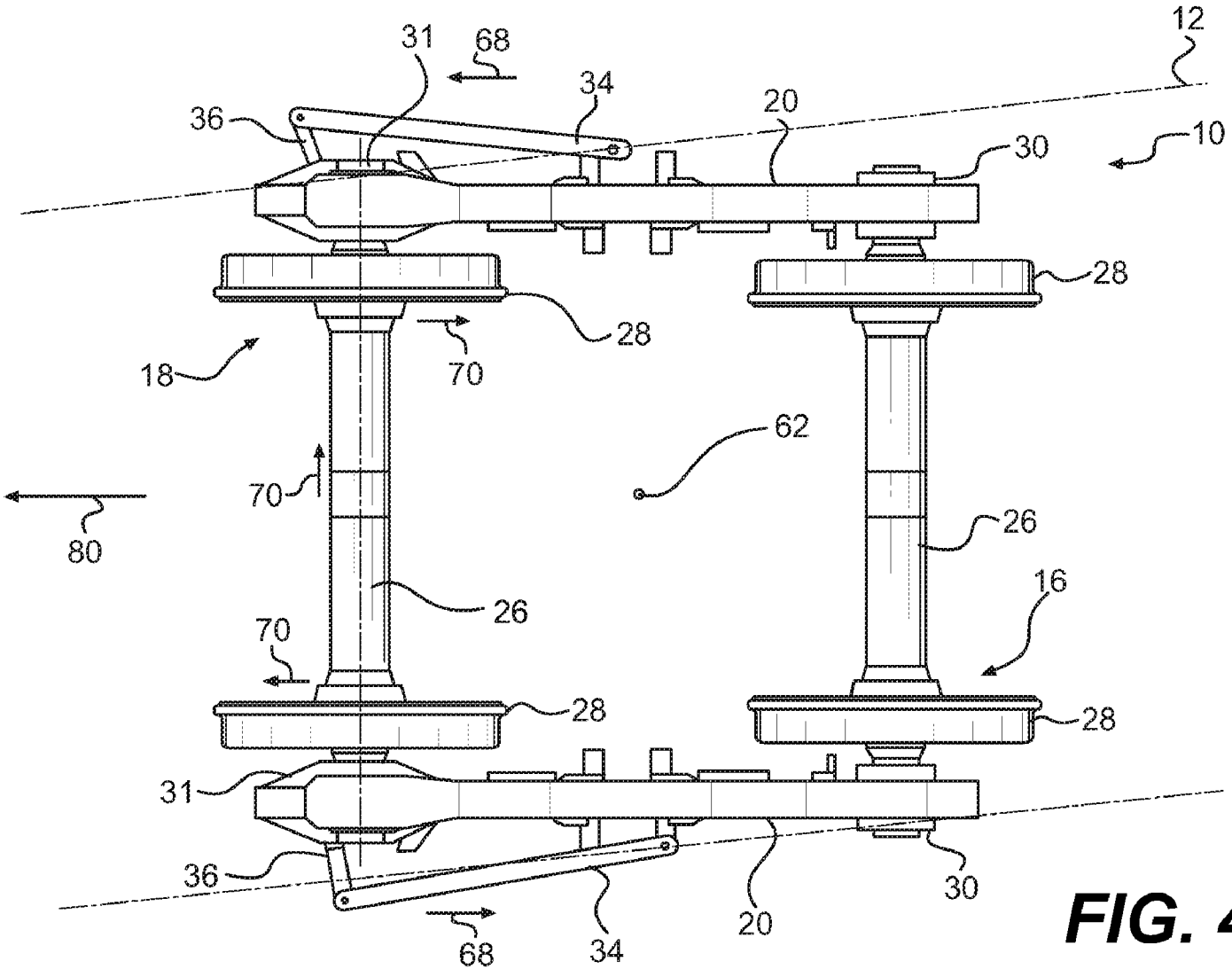
FIG. 4 is a simplified top plan view of a steered axle railway truck according to one embodiment in a right turn.
Figure 4A:
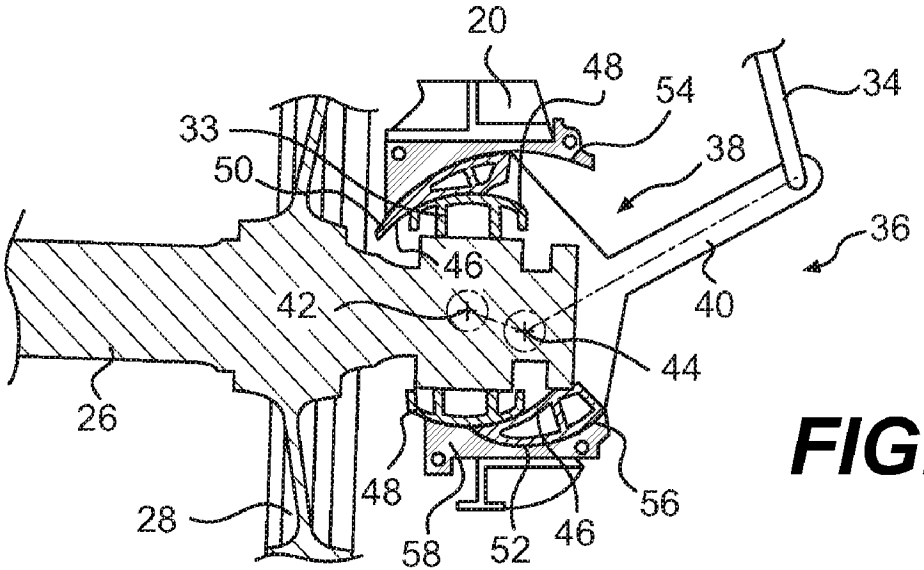
FIG. 4A is a cross-sectional view of a left portion of the steerable wheel-set and frame shown in FIG. 4.

Referring to FIGS. 4 and 4A, as the steered axle railway truck 10 moves in the direction illustrated by arrow 80 and enters a curve to the right, the inertia of the carbody 12 causes the carbody 12 to rotate slightly counter-clockwise relative to the steered axle railway truck 10. As a result, the carbody 12 pulls the steering rod 34 on the left side of the truck 10 (the bottom on FIG. 4) rearwardly and pushes the steering rod 34 on the right side of the truck 10 (the top on FIG. 4) forwardly, as shown by arrows 68. Movement of the steering rods 34 pushes or pulls, as the case may be, on the elongate levers 40 of each of the steering lever 36 to cause the main portions 38 of each steering lever 36 to slide in their corresponding arcuate surfaces 54 and 56 and rotates the steering levers 36 counter-clockwise about their corresponding second pivot axis 44. As the left steering lever 36 rotates counter-clockwise about its second pivot axis 44, the pivotal connection between the steering lever 36 and the bearing assembly 31 at the first pivot axis 42 displaces the bearing assembly 31, and thus the left end portion of the steerable wheel set 18, laterally inwardly and forwardly with respect to the fixed wheel-set 16 and side-frames 20, as shown by arrows 70. As the right steering lever 36 rotates counter-clockwise about its second pivot axis 44, the pivotal connection between the steering lever 36 and the bearing assembly 31 at the first pivot axis 42 displaces the bearing assembly 31, and thus the right end portion of the steerable wheel set 18, laterally outwardly and rearwardly with respect to the fixed wheel-set 16 and side-frames 20, as shown by arrows 70. As a result of this displacement, the steerable wheel-set 18 is no longer perpendicular to the side-frames 20 or parallel to the fixed wheel-set 16, and the steerable wheel-set 18 and fixed wheel-set 16 are both radially aligned with the curve of the rail.

Figure 7:
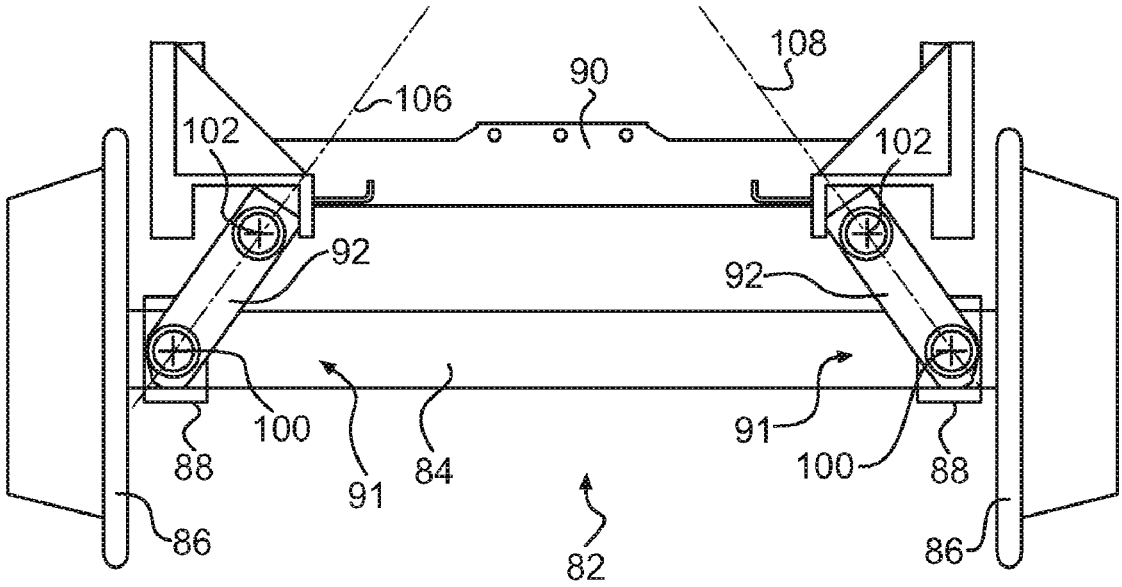
FIG. 7 is a top view of a portion of an alternative embodiment of a steered axle railway truck.
Figure 8:
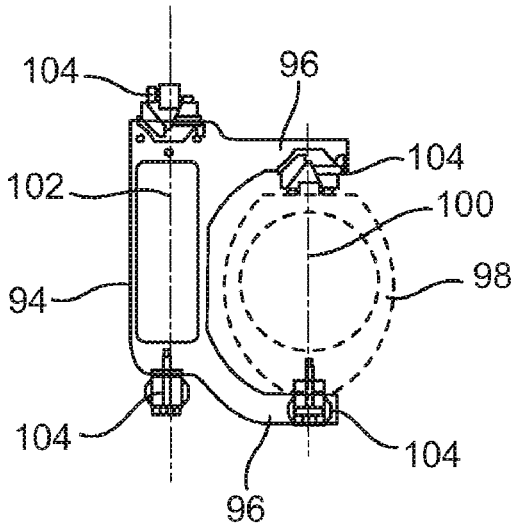
FIG. 8 is a side elevation view of a steering lever of the steered axle railway truck of FIG. 7.
Figure 9:
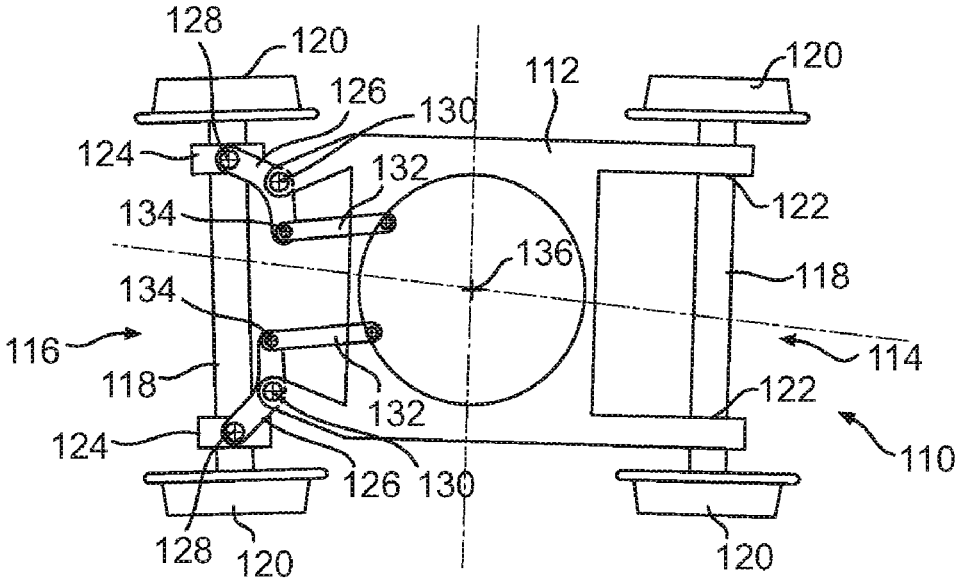
FIG. 9 is a schematic top view of another alternative embodiment of a steered axle railway truck.
Figure 10:
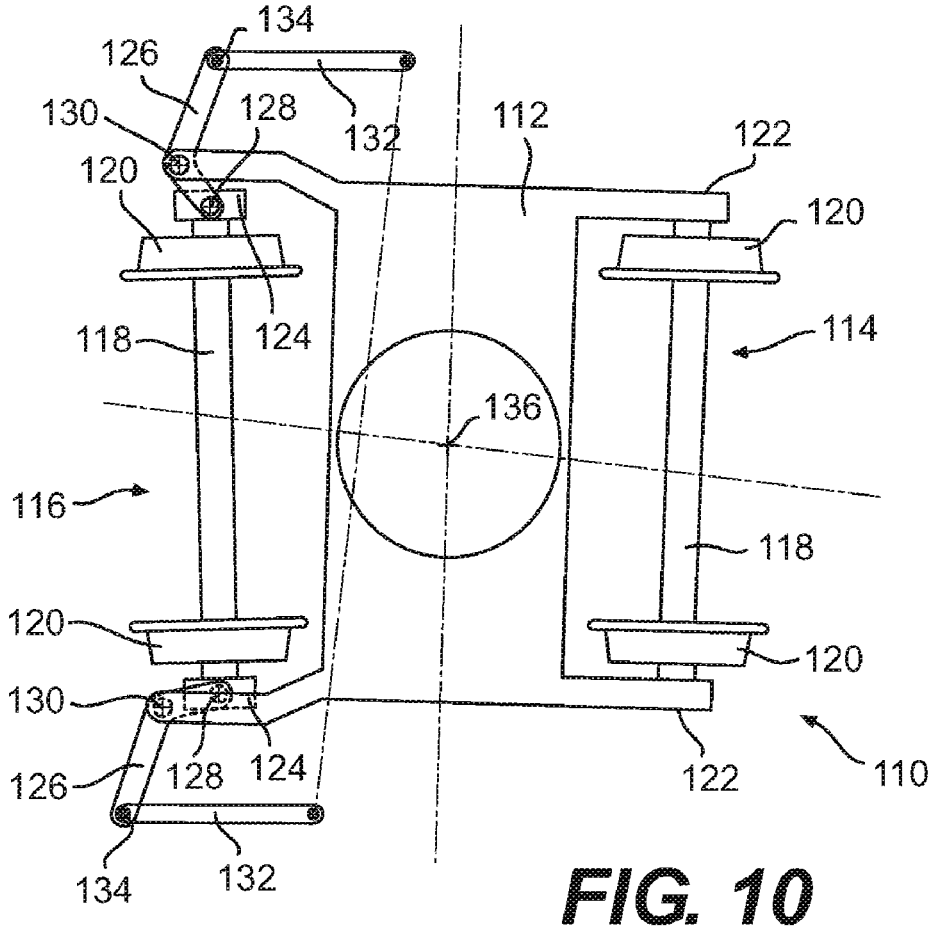
FIG. 10 is a schematic top view of a further alternative embodiment of a steered axle railway truck.
Figure 11:
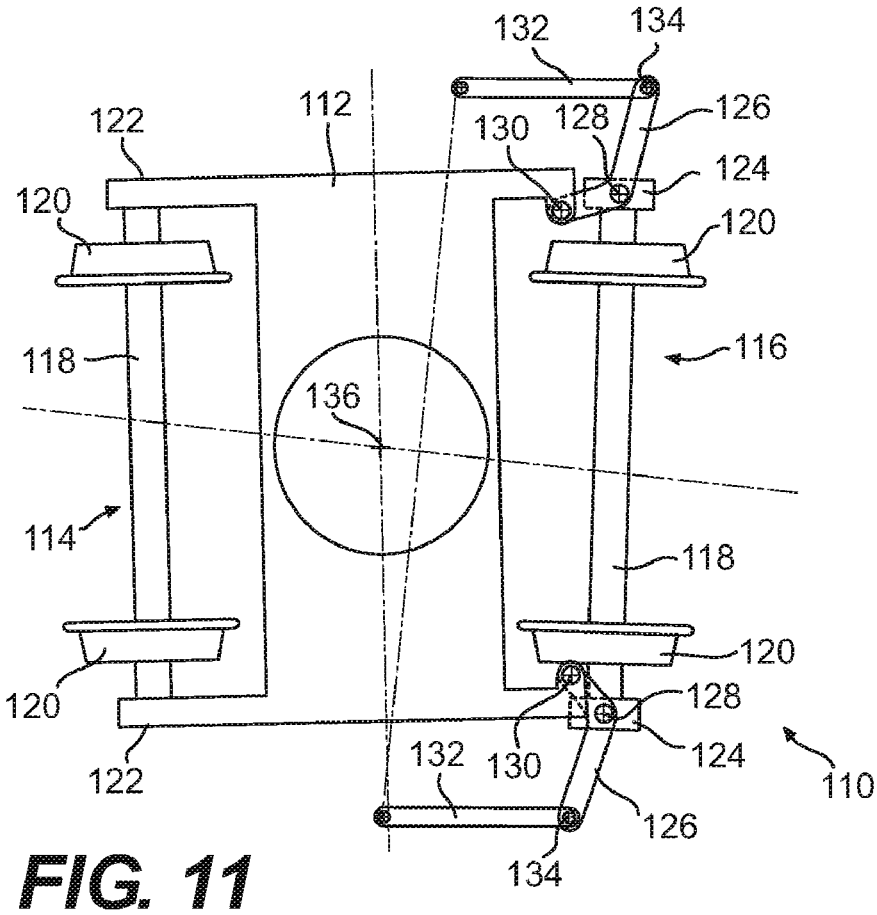
FIG. 11 is a schematic top view of yet another alternative embodiment of a steered axle railway truck.
Figure 12:
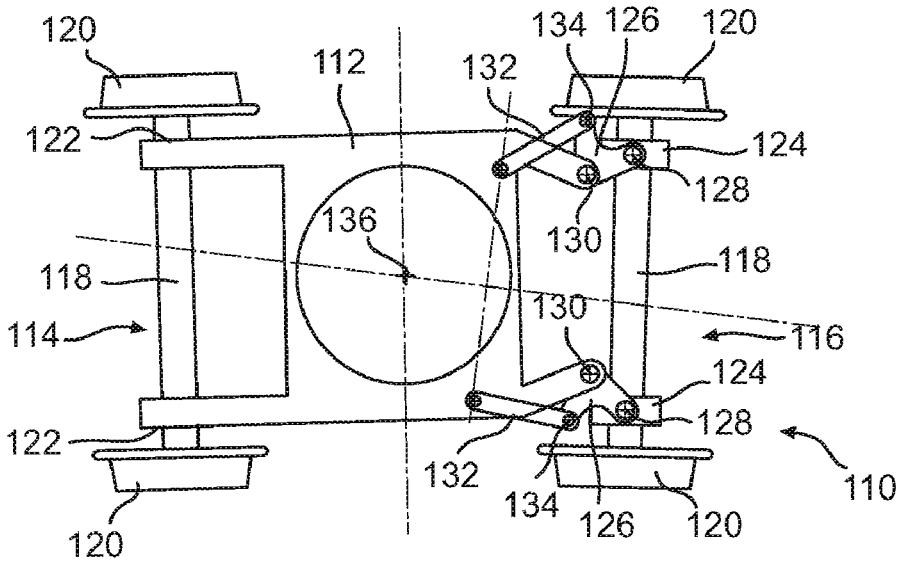
FIG. 12 is a schematic top view of another alternative embodiment of a steered axle railway truck.

Turning now to FIG. 7, a portion of an alternative embodiment of a steered axle railway truck is illustrated. In this embodiment, a steerable wheel-set 82 of the steered axle railway truck includes an axle 84, a pair of conical wheels 86 fixedly connected to the axle 84, and bearing assemblies 88. The truck also includes a fixed wheel-set (not shown). It should be noted that in this embodiment, the bearing assemblies 88 are disposed inboard of the wheels 86. The steerable wheel-set 82 is operatively connected to a frame 90 of the truck by a pair of steering assemblies 91 including steering levers 92 and steering rods (not shown). The steering rods connect the steering levers to a carbody supported by the railway truck. As seen in FIG. 8, each steering lever 92 is generally C-shaped and has a vertical member 94 and a pair of horizontal members 96 extending from the vertical member 94. Each bearing assembly 88 includes a bearing adapter 98 that is pivotally connected between its corresponding pair of horizontal members 96 about a first pivot axis 100. The vertical member 94 is pivotally connected to the frame about a second pivot axis 102. The pivotal connections about the first and second pivot axes 100, 102 of each steering lever 92 are preferably provided by hinge-like pivots 104. As in the previous embodiment, the geometry of the steering assemblies 91 is selected such that a first line 106 passing through the first and second pivot axes 100 and 102 of one steering assembly 91 crosses a second line 108 passing through the first and second pivot axes 100 and 102 of the other steering assembly 91 at less than a predetermined distance from a vertical centerline passing through the geometric center of the truck (as previously defined) when the axle 84 parallel to the other axle (not shown) of the truck. In a preferred embodiment the predetermined distance is less than or equal to one quarter of the wheelbase of the truck (i.e. the distance from the center of one axle to the other). Preferably, the lines 106 and 108 cross at the vertical centerline passing through the geometric center of the truck.

In the embodiment shown in FIG. 7, as the steered axle railway truck enters a curve in a track, the inertia of the carbody causes the carbody to rotate slightly relative to the steered axle railway truck. As a result, the carbody pushes one steering rod and pulls the other. This causes the steering levers 92 to pivot about their respective second pivot axes 102 and the bearing adapters 98 to pivot about their respective first pivot axes 100, which results in the steerable wheel-set 82 being steered to follow the curve in the track. This rotation of the steerable wheel-set 82 also causes a displacement of the frame 90 such that the fixed wheel-set is also steered to follow the curve in the track.

Turning now to FIGS. 9 to 12, top views of other alternative embodiments of a steered railway truck 110 are schematically illustrated. For simplicity similar components have been labelled with the same reference numeral. However, it should be understood that the specific construction and geometry of these components may be different from one embodiment to the other, as will be described below for at least some of these components.

The steered axle railway trucks 110 illustrated in FIGS. 9 to 12 each include a frame 112, a fixed wheel-set 114, and a steerable wheel-set 116. Each wheel-set 114, 116 generally includes an axle 118, a pair of conical wheels 120, and bearing assemblies 122 (for the fixed-wheel set 114) or 124 (for the steerable wheel set 116). The conical wheels 120 are fixedly connected to the axles 118. In this manner, the conical wheels 120 rotate at the same speed as the axles 118. The bearing assembly 122, 124 operably connect each wheel-set 114, 116 to the frame 112 so that the axles 118 and wheels 120 rotate freely as the truck 110 travels along the rails. For each truck 110, the steerable wheel-set 116 is operatively connected to the frame 112 by a pair of steering levers 126. Each bearing assembly 124 is pivotally connected to its corresponding steering lever 126 about a first pivot axis 128. Each steering lever 126 is pivotally connected to the frame 112 about a second pivot axis 130 and to a steering rod 132 about a third pivot axis 134. Each steering rod 132 is pivotally connected to a carbody supported by the railway truck 110 such that pivotal movement of the carbody relative to the truck 110 pushes on one steering rod 132 and pulls on the other so as to rotate the steering levers 126 and therefore steer the steerable wheel-set 116, and as a result the fixed wheel set 114, in a manner similar to the one described above with respect to the embodiment shown in FIG. 7.

One of the differences between the trucks 110 shown in FIGS. 9 to 12 is the position of the bearing assemblies 122, 124 relative to the wheels 120. Another difference is the position of the steerable wheel-set 116. In the truck 110 illustrated in FIG. 9, the bearing assemblies 122, 124 are disposed inboard of the wheels 120 (i.e. closer to a longitudinal centerline of the truck 110 than the wheels 120) and the steerable wheel-set 116 is the outboard wheel-set (i.e. the wheel-set located closer to the end of its associated carbody). In the truck 110 illustrated in FIG. 10, the bearing assemblies 122, 124 are disposed outboard of the wheels 120 (i.e. farther away from a longitudinal centerline of the truck 110 than the wheels 120) and the steerable wheel-set 116 is the outboard wheel-set. In the truck 110 illustrated in FIG. 11, the bearing assemblies 122, 124 are disposed outboard of the wheels 120 and the steerable wheel-set 116 is the inboard wheel-set (i.e. the wheel-set located farther away from the end of its associated carbody). In the truck 110 illustrated in FIG. 12, the bearing assemblies 122, 124 are disposed inboard of the wheels 120 and the steerable wheel-set 116 is the inboard wheel-set (i.e. the wheel-set located farther away from the end of its associated carbody).

As can be seen in FIGS. 9 to 12, these differences between the trucks 110 in these figures result in different geometries of their corresponding steering levers 126 and different positions of the steering rods 132. However, for each truck 110, the geometry of the steering levers 126 is selected such that a first line passing through the first and second pivot axes 128 and 130 of one steering lever 126 crosses a second line passing through the first and second pivot axes 128 and 130 of the other steering lever 126 at less than a predetermined distance from a vertical centerline passing through the geometric center 136 of the truck 110 (as previously defined) when the axles 118 are parallel to each other (note that in each of FIGS. 9 to 12, the steerable wheel-set 116 is shown in a steered position, and as such, the axles 118 are not shown parallel to each other). In a preferred embodiment the predetermined distance is less than or equal to one quarter of the wheelbase of the truck 110 (i.e. the distance from the center of one axle to the other). Preferably, the lines cross at the vertical centerline passing through the geometric center 136 of the truck 110.

It should be appreciated by those skilled in the art that modifications and variations can be made to the embodiments set forth herein without departing from the scope and spirit of the invention as set forth in the appended claims and their equivalents.

What is claimed is:

1. A railway truck comprising:

a frame;

a first wheel-set operatively connected to the frame, the first wheel-set including:

a first axle having a first end portion and a second end portion opposite the first end portion;

a first wheel disposed on the first end portion of the first axle; and a second wheel disposed on the second end portion of the first axle;

a second wheel-set operatively connected to the frame, the second wheel-set including:

a second axle having a first end portion and a second end portion opposite the first end portion;

a third wheel disposed on the first end portion of the second axle; and a fourth wheel disposed on the second end portion of the second axle;

a first steering lever pivotally connected to the first end portion of the first axle about a first generally vertical pivot axis, the first steering lever being pivotally connected to the frame about a second generally vertical pivot axis, the first pivot axis being laterally offset from the second pivot axis;

a second steering lever pivotally connected to the second end portion of the first axle about a third generally vertical pivot axis, the second steering lever being pivotally connected to the frame about a fourth generally vertical pivot axis, the third pivot axis being laterally offset from the fourth pivot axis; and a first steering rod having a first end pivotally connected to the first steering lever at a point disposed on the first steering lever and being laterally offset from the first and second pivot axes and a second end having a connection at a point laterally offset from a longitudinal centerline of the truck and on a same side of the longitudinal centerline as the first steering lever and operatively pivotally connected at said connection to a carbody when the truck supports the carbody;

wherein a first generally horizontal line passing through the first and second pivot axes crosses a second generally horizontal line passing through the third and fourth pivot axes at less than a predetermined distance from a vertical centerline of the truck when the first and second axles are parallel, the vertical centerline passing through a geometric center of the first and second wheel-sets, the geometric center being a point that is equidistant from a center of each of the first, second, third, and fourth wheels when the first and second axles are parallel.

2. The railway truck of claim 1, wherein the predetermined distance is less than or equal to one quarter of a wheelbase of the truck.

3. The railway truck of claim 1, wherein the first line and the second line cross at the vertical centerline of the truck.

4. The railway truck of claim 1, wherein rotation of the first steering lever about the second pivot axis in a first direction and of the second steering lever about the fourth pivot axis in the first direction causes displacement of the first and third pivot axes and results in a rotation of the first wheel-set about a vertical axis.

5. The railway truck of claim 1, further comprising:

a first bearing adapter journaled on the first end portion of the first axle;

a second bearing adapter journaled on the second end portion of the first axle;

wherein the first steering lever is pivotally connected to the first bearing adapter about the first pivot axis, and the second steering lever is pivotally connected to the second bearing adapter about the third pivot axis.

6. The railway truck of claim 5, wherein the first steering lever includes:

first inner arcuate surfaces journaling corresponding outer surfaces of the first bearing adapter, a center of curvature of the first inner arcuate surfaces corresponding to the first pivot axis; and first outer arcuate surfaces journaled in corresponding first inner arcuate surfaces of the frame, a center of curvature of the first outer arcuate surfaces corresponding to the second pivot axis; and wherein the second steering lever includes:

second inner arcuate surfaces journaling corresponding outer surfaces of the second bearing adapter, a center of curvature of the second inner arcuate surfaces corresponding to the third pivot axis; and second outer arcuate surfaces journaled in corresponding second inner arcuate surfaces of the frame, a center of curvature of the second outer arcuate surfaces corresponding to the fourth pivot axis.

7. The railway truck of claim 5, wherein the first steering lever is generally C-shaped and has a first vertical member and a first pair of horizontal members extending from the first vertical member, the first vertical member being pivotally connected to the frame about the second pivot axis, and the first bearing adapter being pivotally connected between the first pair of horizontal member about the first pivot axis; and wherein the second steering lever is generally C-shaped and has a second vertical member and a second pair of horizontal members extending from the second vertical member, the second vertical member being pivotally connected to the frame about the fourth pivot axis, and the second bearing adapter being pivotally connected between the second pair of horizontal member about the third pivot axis.

8. The railway truck of claim 1, further comprising a second steering rod having a first end pivotally connected to the second steering lever at a point disposed on the second steering lever and being laterally offset from the third and fourth pivot axes and a second end having connection at a point laterally offset from the longitudinal centerline of the truck and on a same side of the longitudinal centerline as the second steering lever and operatively pivotally connected at said connection of the second end to the carbody when the truck supports the carbody.

9. The railway truck of claim 1, wherein the frame includes:

a pair of side-frames;

a bolster extending between the pair of side-frames; and a suspension operatively connecting the bolster to the side-frames.

10. A railway truck comprising:

a frame;

a first wheel-set operatively connected to the frame, the first wheel-set including:

a first axle having a first end portion and a second end portion opposite the first end portion;

a first wheel disposed on the first end portion of the first axle; and a second wheel disposed on the second end portion of the first axle;

a second wheel-set operatively connected to the frame, the second wheel-set including:

a second axle having a first end portion and a second end portion opposite the first end portion;

a third wheel disposed on the first end portion of the second axle; and a fourth wheel disposed on the second end portion of the second axle;

a first bearing adapter journaled on the first end portion of the first axle;

a second bearing adapter journaled on the second end portion of the first axle;

a first steering lever pivotally connected to the first bearing adapter about a first generally vertical pivot axis, the first steering lever being pivotally connected to the frame about a second generally vertical pivot axis, the first pivot axis being laterally offset from the second pivot axis, the first steering lever including:

first inner arcuate surfaces journaling corresponding outer surfaces of the first bearing adapter, a center of curvature of the first inner arcuate surfaces corresponding to the first pivot axis; and first outer arcuate surfaces journaled in corresponding first inner arcuate surfaces of the frame, a center of curvature of the first outer arcuate surfaces corresponding to the second pivot axis;

a second steering lever pivotally connected to the second end bearing adapter about a third generally vertical pivot axis, the second steering lever being pivotally connected to the frame about a fourth generally vertical pivot axis, the third pivot axis being laterally offset from the fourth pivot axis, the second steering lever including:

second inner arcuate surfaces journaling corresponding outer surfaces of the second bearing adapter, a center of curvature of the second inner arcuate surfaces corresponding to the third pivot axis; and second outer arcuate surfaces journaled in corresponding second inner arcuate surfaces of the frame, a center of curvature of the second outer arcuate surfaces corresponding to the fourth pivot axis;

wherein a first generally horizontal line passing through the first and second pivot axes crosses a second generally horizontal line passing through the third and fourth pivot axes at less than a predetermined distance from a vertical centerline of the truck when the first and second axles are parallel, the vertical centerline passing through a geometric center of the first and second wheel-sets, the geometric center being a point that is equidistant from a center of each of the first, second, third, and fourth wheels when the first and second axles are parallel.

11. The railway truck of claim 10, wherein the predetermined distance is less than or equal to one quarter of a wheelbase of the truck.

12. The railway truck of claim 10, wherein the first line and the second line cross at the vertical centerline of the truck.

13. The railway truck of claim 10, wherein rotation of the first steering lever about the second pivot axis in a first direction and of the second steering lever about the fourth pivot axis in the first direction causes displacement of the first and third pivot axes and results in a rotation of the first wheel-set about a vertical axis.

14. A railcar comprising:

at least two railway trucks, each of the at least two railway trucks including:

a frame;

a first wheel-set operatively connected to the frame, the first wheel-set including:

a first axle having a first end portion and a second end portion opposite the first end portion;

a first wheel disposed on the first end portion of the first axle; and a second wheel disposed on the second end portion of the first axle;

a second wheel-set operatively connected to the frame, the second wheel-set including:

a second axle having a first end portion and a second end portion opposite the first end portion;

a third wheel disposed on the first end portion of the second axle; and a fourth wheel disposed on the second end portion of the second axle;

at least one of the at least two railway trucks further including:

a first steering lever pivotally connected to the first end portion of the first axle about a first generally vertical pivot axis, the first steering lever being pivotally connected to the frame about a second generally vertical pivot axis, the first pivot axis being laterally offset from the second pivot axis; and a second steering lever pivotally connected to the second end portion of the first axle about a third generally vertical pivot axis, the second steering lever being pivotally connected to the frame about a fourth generally vertical pivot axis, the third pivot axis being laterally offset from the fourth pivot axis;

wherein a first generally horizontal line passing through the first and second pivot axes crosses a second generally horizontal line passing through the third and fourth pivot axes at less than a predetermined distance from a vertical centerline of the at least one of the at least two railway trucks when the first and second axles are parallel, the vertical centerline passing through a geometric center of the first and second wheel-sets, the geometric center being a point that is equidistant from a center of each of the first, second, third, and fourth wheels when the first and second axles are parallel;

a carbody pivotally supported by the frame of the at least one of the at least two railway trucks and supported by the frame of another of the at least two railway trucks; and a first steering rod having a first end pivotally connected to the first steering lever at a point disposed on the first steering lever and being laterally offset from the first and second pivot axes and a second end operatively pivotally connected to the carbody at a point laterally offset from a longitudinal centerline of the truck and on a same side of the longitudinal centerline as the first steering.

15. The railcar of claim 14, further comprising a second steering rod having a first end pivotally connected to the second steering lever at a point disposed on the second steering lever and being laterally offset from the third and fourth pivot axes and a second end operatively pivotally connected to the carbody at a point laterally offset from a longitudinal centerline of the truck and on a same side of the longitudinal centerline as the second steering lever.

16. The railcar of claim 14, wherein the predetermined distance is less than or equal to one quarter of a wheelbase of the at least one of the at least two railway trucks.

17. The railcar of claim 14, wherein the first line and the second line cross at the vertical centerline of the at least one of the at least two railway trucks.

18. The railcar of claim 14, wherein rotation of the carbody relative to the frame of the at least one of the at least two railway trucks causes rotation of the first steering lever about the second pivot axis in a first direction and rotation of the second steering lever about the fourth pivot axis in the first direction; and wherein the rotation of the first and second steering levers in the first direction causes displacement of the first and third pivot axes and results in a rotation of the first wheel-set about a vertical axis.

19. The railcar of claim 14, wherein the at least one of the at least two railway trucks further includes:

a first bearing adapter journaled on the first end portion of the first axle;

a second bearing adapter journaled on the second end portion of the first axle;

wherein the first steering lever is pivotally connected to the first bearing adapter about the first pivot axis, and the second steering lever is pivotally connected to the second bearing adapter about the third pivot axis.

20. The railcar of claim 19, wherein the first steering lever includes:

first inner arcuate surfaces journaling corresponding outer surfaces of the first bearing adapter, a center of curvature of the first inner arcuate surfaces corresponding to the first pivot axis; and first outer arcuate surfaces journaled in corresponding first inner arcuate surfaces of the frame, a center of curvature of the first outer arcuate surfaces corresponding to the second pivot axis; and wherein the second steering lever includes:

second inner arcuate surfaces journaling corresponding outer surfaces of the second bearing adapter, a center of curvature of the second inner arcuate surfaces corresponding to the third pivot axis; and second outer arcuate surfaces journaled in corresponding second inner arcuate surfaces of the frame, a center of curvature of the second outer arcuate surfaces corresponding to the fourth pivot axis.

21. The railcar of claim 19, wherein the first steering lever is generally C-shaped and has a first vertical member and a first pair of horizontal members extending from the first vertical member, the first vertical member being pivotally connected to the frame about the second pivot axis, and the first bearing adapter being pivotally connected between the first pair of horizontal member about the first pivot axis; and wherein the second steering lever is generally C-shaped and has a second vertical member and a second pair of horizontal members extending from the second vertical member, the second vertical member being pivotally connected to the frame about the fourth pivot axis, and the second bearing adapter being pivotally connected between the second pair of horizontal member about the third pivot axis.

22. The railcar of claim 14, wherein the frame of each of the at least two railway trucks includes:

a pair of side-frames;

a bolster extending between the pair of side-frames and pivotally supporting the carbody; and a suspension operatively connecting the bolster to the side-frames.

23. The railcar of claim 14, wherein the at least one of the at least two railway trucks is disposed near a first end of the carbody and the other one of the at least two railway trucks is disposed near a second end of the carbody opposite the first end; and wherein the other of the at least two railway trucks further includes:

a first steering lever pivotally connected to the first end portion of the first axle about a first generally vertical pivot axis, the first steering lever being pivotally connected to the frame about a second generally vertical pivot axis, the first pivot axis being laterally offset from the second pivot axis; and a second steering lever pivotally connected to the second end portion of the first axle about a third generally vertical pivot axis, the second steering lever being pivotally connected to the frame about a fourth generally vertical pivot axis, the third pivot axis being laterally offset from the fourth pivot axis;

wherein a first generally horizontal line passing through the first and second pivot axes crosses a second generally horizontal line passing through the third and fourth pivot axes at less than a predetermined distance from a vertical centerline of the other of the at least two railway trucks when the first and second axles are parallel, the vertical centerline passing through a geometric center of the first and second wheel-sets, the geometric center being a point that is equidistant from a center of each of the first, second, third, and fourth wheels when the first and second axles are parallel.

* * * * *

UNITED STATES PATENT AND TRADEMARK OFFICE

CERTIFICATE OF CORRECTION

PATENT NO. : 7,845,287 B2
APPLICATION NO. : 12/019274
DATED : December 7, 2010
INVENTOR(S) : Roy Edward Smith It is certified that error appears in the above-identified patent and that said Letters Patent is hereby corrected as shown below:

Column 16, line 43, -- lever -- should be added after "steering"

Signed and Sealed this
Eighth Day of February, 2011

David J. Kappos

David J. Kappos
*Director of the United States Patent and Trademark Office*